United States Patent [19]

Martin

[11] Patent Number: 4,899,933

[45] Date of Patent: Feb. 13, 1990

[54] RAILWAY CROSSING INSERT

[76] Inventor: John K. Martin, 419 Oakside Cir. SW., Calgary, Alberta, Canada, T2B 4V3

[21] Appl. No.: 40,011

[22] Filed: Mar. 25, 1987

[51] Int. Cl.[4] ..... E01C 9/04

[52] U.S. Cl. ..... 238/8; 238/379

[58] Field of Search ..... 238/2, 3, 6–9, 238/379, 381; 404/17, 32, 33

[56] References Cited

U.S. PATENT DOCUMENTS

| | | | |
|---|---|---|---|
| 1,881,660 | 10/1932 | Keller | 238/8 |
| 1,941,967 | 1/1939 | Bell | 238/8 |
| 3,469,783 | 9/1969 | Uralli | 238/8 |
| 3,825,184 | 7/1974 | Hartl | 238/8 |
| 4,372,488 | 2/1983 | Schonthaler | 238/8 |
| 4,457,468 | 7/1984 | Hales | 238/8 |
| 4,461,421 | 7/1984 | Maass | 238/8 |
| 4,656,498 | 8/1986 | Grant | 238/8 |

*Primary Examiner*—Joseph F. Peters, Jr.
*Assistant Examiner*—Clifford T. Bartz
*Attorney, Agent, or Firm*—George Dunsmuir

[57] ABSTRACT

An insert for use in a level railway crossing includes an elongated high molecular weight body defined by a generally trapezoidal head with one planar vertical side edge, a shoulder extending outwardly and downwardly from the other side edge of the head for bearing against the bottom of one side of the head of a rail, a bottom portion for extending downwardly into engagement with the top surface of the base of the rail at the junction between such top surface and the vertical web of the rail, and circular cross section seals in longitudinally extending rectangular grooves in the one side edge of the head and in the inclined top surface of the shoulder for sealing with an adjacent plank and with the rail. The insert restricts the entry of the water and other foreign matter into the area of the bottom of the rails.

20 Claims, 4 Drawing Sheets

RAILWAY CROSSING INSERT

BACKGROUND OF THE INVENTION

The invention relates to a railway crossing structure, and in particular to a railway crossing insert.

In general, railway crossing structures, particularly in urban areas, are subjected to a fair amount of abuse and consequently require frequent repair. Moreover, the conventional structures include channels beside the rails which collect water and other foreign matter. The water passes to the rail bed causing deterioration of the crossing structure, and foreign matter necessitates frequent maintenance.

The object of the present invention is to overcome the above-identified problem by providing a relatively simple railway crossing structure and in particular an insert for use in such a structure.

Another object of the invention is to provide an insert for use in a railway crossing which prevents or reduces the passage of water and other foreign matter to the rail bed, minimizing maintenance, and which provides a non-conductive surface adjacent to the rails.

SUMMARY OF THE INVENTION

Accordingly, the present invention relates to a railway crossing insert for use in a railway crossing structure of the type defined by centre planks between the rails and, optionally outside planks on the outer sides of the rails, said insert comprising elongated body means for use between each plank and one side of a rail, said body means including a head portion having one straight side edge for engaging one side edge of a plank or roadway, a shoulder extending outwardly from the other side edge of said head portion for insertion beneath the head of a rail, and an inclined bottom portion extending downwardly from said head portion for resting against an inner top edge of a rail bottom; first sealing means for providing a seal between said one side edge of said head portion and an adjacent plank or roadway; and second sealing means for providing a seal between said shoulder and the head of the rail.

The invention also relates to a railway crossing structure incorporating the above described insert, and including elongated board means extending longitudinally of each rail on each side thereof, an insert being provided between each board and each rail, the board means between the rails providing a surface in approximately the same plane as the top edge of the rails.

BRIEF DESCRIPTION OF THE DRAWINGS

The invention will now be described in greater detail with reference to the accompanying drawings, which illustrate preferred embodiments of the invention, and wherein.

DESCRIPTION OF THE PREFERRED EMBODIMENT(S)

Figure 1:
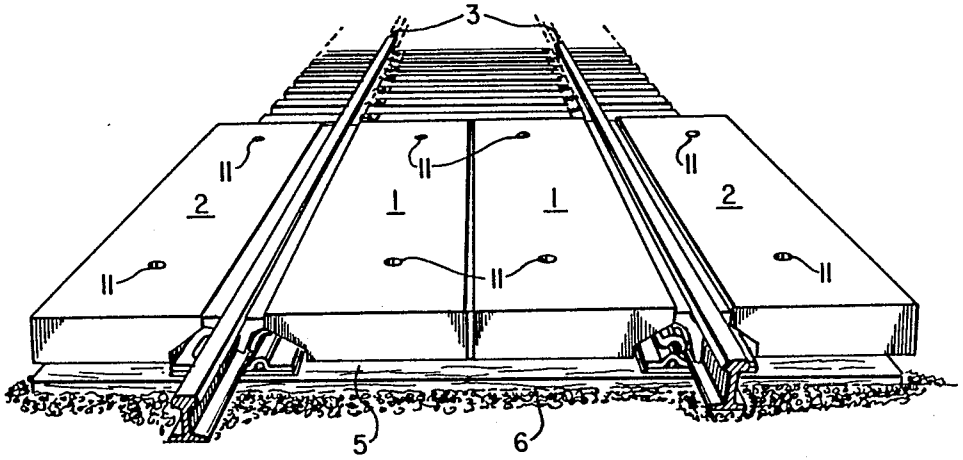
FIG. 1 is a perspective view from above of a railway crossing structure in accordance with the present invention.
Figure 2:
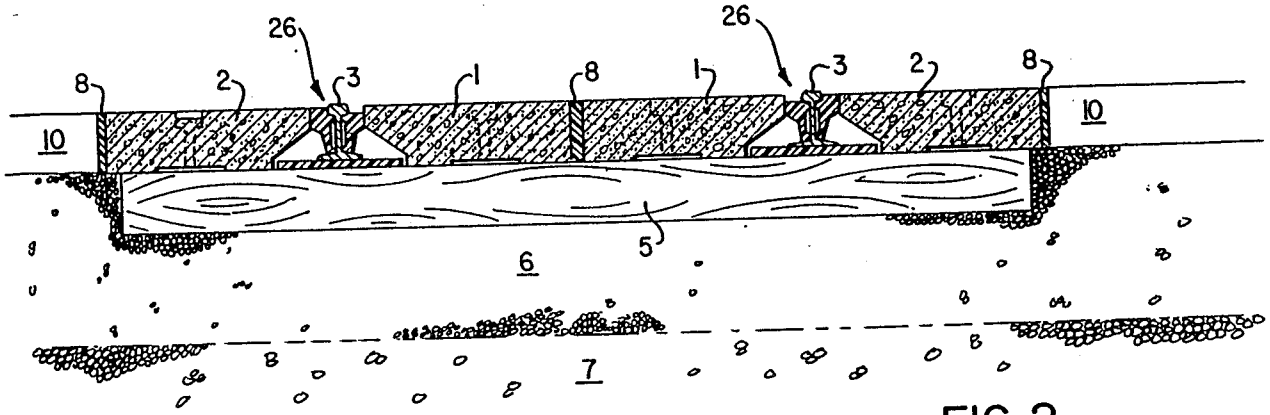
FIG. 2 is a cross-sectional view of the structure of FIG. 1.

With reference to FIGS. 1 and 2, the railway crossing structure of the present invention includes a pair of elongated inner or central concrete planks 1 and elongated outer planks 2, which are similar to the planks 1. The planks 1 and 2 are placed on each side of a pair of rails 3 on ties 5. The ties 5 are supported by sub-ballast 6 and an approximately twenty-five centimeter thick layer 7 of crushed rock ballast. A rigid sealing strip 8 formed of ultra high molecular weight material is provided between the central planks 1, and between each outer plank 2 and the top layer 10 of the adjacent road. The strip 8 is intended to minimize movement of the planks 1 and 2, and to provide a more secure fit and an additional non-conductive insulator between the steel rails 3. Countersunk holes 11 are provided in the planks 1 and 2 for receiving screw spikes (not shown) for connecting the planks to the ties 5, and for receiving handles (not shown) for lifting the planks 1 and 2. The holes are capped with a polyurethane plug.

Figure 3:
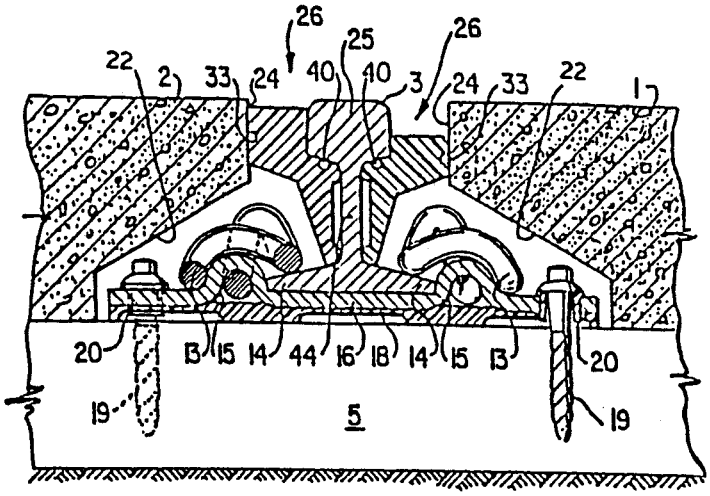
FIG. 3 is a cross-sectional view of a portion of the structure of FIG. 1 on a larger scale.
Figure 4:
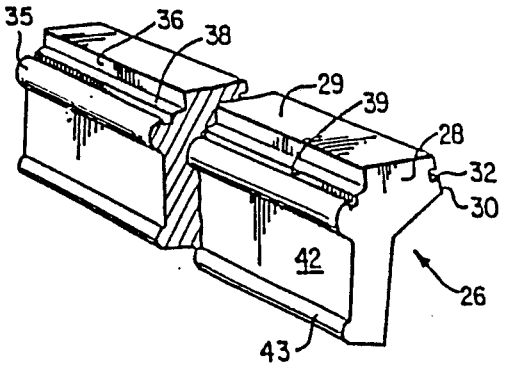
FIG. 4 is a perspective view of an insert for use in the structure of FIGS. 1 and 3.

As best shown in FIG. 3 each rail 3 is connected on each tie 5 by Pandrol (trademark) rail clips 13. The clips 13 extend between the bottom flanges 14 of the rail 3 and grooves 15 in Landis-Pandrol (trademark) steel track plates 16. The plates 16 are spaced from the ties 5 by rubber pads 18. The plates 16 are connected to the ties 5 by screw spikes 19, which are equipped with nylon insulators 20. A notch 22 is provided in one bottom side edge 24 of each plank 1 and 2 for accommodating the clips 13, the plates 16 the pads 18 and the spikes 19.

The head 25 of each rail 3 is spaced from the edge 24 of the plank 1 or 2 by an insert generally indicated at 26. The inserts 26 are formed of ultra high molecular weight polyethylene, which gives the inserts high impact strength and abrasion resistance, a low coefficient of friction which makes the inserts virtually self-cleaning, resistance to chemicals, and provides excellent electrical insulating properties. The inserts 26 also have high tensile and tear strength, with minimum expansion when subjected to extreme temperature changes. Cyclical fatigue and stress crack resistance of the inserts are also excellent. Each insert 26 includes a generally trapezoidal head portion 28, with a planar horizontal top surface 29 and a planar vertical side edge 30 perpendicular thereto. A square longitudinally extending groove 32 is provided in such side edge 30 for receiving a rubber seal 33 (FIG. 3) of circular cross section. A shoulder 35 extends outwardly and downwardly from the bottom of the other side 36. The inclined, planar top surface 38 of the shoulder 35 contains a square groove 39, which also receives a seal 40 (FIG. 3). Approximately, one-third of each seal 33 or 40 projects out of the groove 32 or 39, respectively for sealing against the adjacent side edge 24 of the plank 1 or 2 and against the bottom edge of the head 25 of the rail 3.

The bottom portion 42 of the insert 26 tapers downwardly to a convex foot 43, which bears against the bottom of the web 44 of the rail 3. Thus, while the insert 26 is tightly sandwiched between a plank 1 or 2 and a rail 3, the seals 33 and 40 permit some lateral and vertical movement. The seals 33 and 40 prevent the entry of water and other foreign matter into the tie area around the track plates 16.

Figure 6:
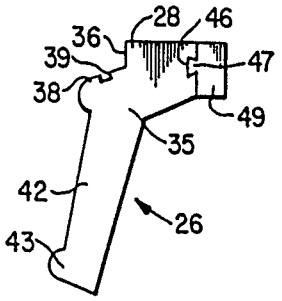
FIG. 6 is an end view of a second embodiment of the insert.

A second form of insert 26 (FIG. 6) includes a mortise 46 for mating with a tenon 47 on a strip 49 to define a dovetail joint. The strip 49 is used to widen the head portion 28 of the insert 26 for use on shallow radius curves where the gap between the rail 3 and the roadway varies in width because of the rectangular shape of adjacent planks. The strip 49 can include a square groove for receiving a seal 33.

Figure 5:
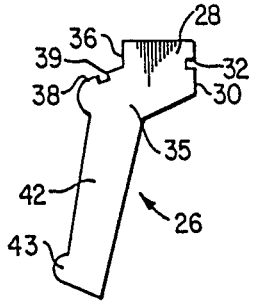
FIG. 5 is an end view of the insert of FIG. 4.
Figure 7:
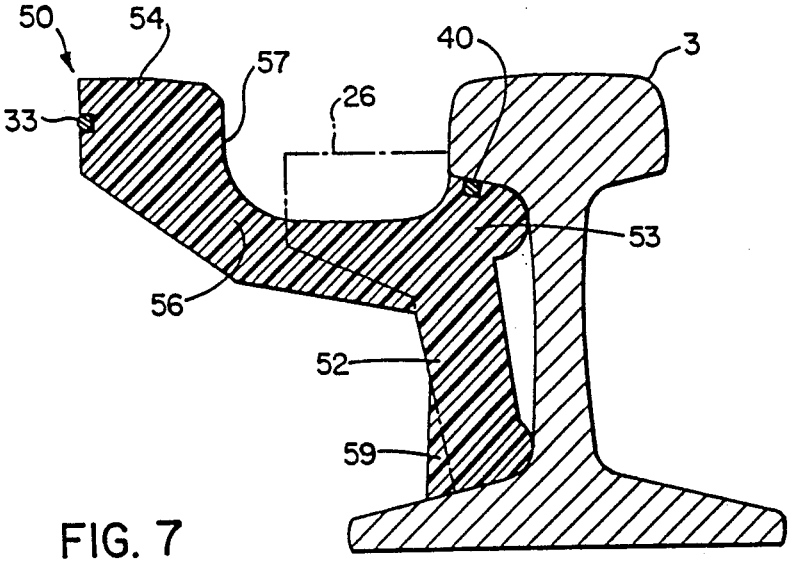
FIG. 7 is a cross-sectional view of a rail and a third embodiment of the insert of the present invention.

Referring to FIG. 7, a third form of insert 50 is substantially wider and somewhat taller than the insert 26 of FIG. 5 (approximately 2½ inches wider and 1¼ inches taller) to accommodate the standard gauge width required by railroads. Moreover, the top of the insert 50 is level with the top of the rail 3 on the concrete or wood plank side. The insert 50 is generally Y-shaped in cross section, with an inclined stem or bottom portion 52 on one side, a small convex arm 53 above the bottom portion and a larger arm 54 connected to the bottom portion 52 by a web 56. The arms 53 and 54 and the web 56 define a longitudinally extending generally U-shaped recess 57. Thus, in effect, a portion of the top of the insert 26 of FIG. 5 (shown in phantom outline) has been removed to accommodate the wheel flanges of railroad vehicles. Finally, a small wedge 59 has been added to the lower foot section of the insert 50 to assist in holding the insert in position against a Pandrol clip or cut spike during installation.

In cases where no outer planks 2 are used, the seal 33 bears against the pavement (not shown) of an adjacent roadway. The use of an elongated narrow body extending downwardly at an obtuse angle to the head of the insert permits installation on rails using spiked tie plates and/or Pandrol-type clips. The inserts rest directly on the steel rails and move when the rails move. Because the inserts are not spiked directly to the ties, excessive movement between the rails and ties is reduced. A significant advantage of the insert is that it can be used with different fastening systems such as spiked tie plates, Pandrol and a Lord (trademark) without changing the profile or cross-sectional shape of the insert.

Thus, there has been described an insert for use in a level railway crossing which holds planks firmly in place, prevents or reduces the build-up of foreign material in the flangeway, and permits the lowering of crossing planks directly into position and easy removal of the planks. The profile of the insert is such that it can be used in asphalt crossing. The ultra high molecular weight material will withstand the high temperature of the asphalt during installation and will remain firmly in position when the asphalt cools. Moreover, the insert will reduce the likelihood of the asphalt crumbling or breaking along the edge.

What is claimed is:

1. A railway crossing structure for use in a railway crossing of the type defined by center planks between the rails and outside planks on the outer sides of the rails and the rails being retained in place by rail clips, said structure comprising:

(a) first elongated body means for insertion between a plank and one side of a rail, (b) second elongated body means for insertion between another plank and the other side of the rail, (c) each of said body means including a head portion having one straight side edge for engaging one side edge of a plank and a shoulder extending outwardly from the other side edge of said head portion for insertion beneath the head of a rail, (d) said head portion of said first elongated body means extending from a top edge of the rail to a top edge of the plank when inserted between the rail and the side edge of the plank, (e) said head portion of said second elongated body means having a portion for providing a recess below the top edge of the rail when inserted between the rail and the side edge of the other plank, (f) both first and second elongated body means having an inclined bottom portion extending downwardly from said head portion to a foot portion for resting on an inner top edge of a bottom flange of the rail; and, (g) whereby, said head portions provide a cover over the rail clips and provide an open space around the rail clips permitting the rail clips to flex when said first and second elongated body means are inserted.

2. The railway crossing structure of claim 1, wherein:

(a) each of said straight side edges has a top and a bottom, (b) said elongated body has a sloped surface extending from said straight side edge bottom downwardly to said foot portion.

3. The railway crossing structure of claim 1, wherein:

(a) said shoulder portion protrudes outwardly from said body means for engagement directly beneath the head of the rail, (b) said foot portion has a surface for bearing against the inner top edge of the rail bottom flange.

4. The railway crossing structure of claim 1, wherein:

(a) said downwardly inclined portion is spaced from the rail intermediate said shoulder portion and said foot portion when said elongated body means is inserted between the planks and the rail.

5. A railway crossing insert for use in a railway crossing structure of the type defined by center planks between the rails and, optionally outside planks on the outer sides of the rails, said insert comprising:

(a) elongated body means for use between each plank and one side of a rail, (b) said body means including a head portion having one straight side edge for engaging one side edge of a plank or roadway, (c) a shoulder extending outwardly from the other side edge of said head portion for insertion beneath the head of a rail, (d) an inclined bottom portion extending downwardly from said head portion for resting against an inner top edge of a rail bottom, (e) first sealing means for providing a seal between said one side edge of said head portion and an adjacent plank or roadway, (f) second sealing means for providing a seal between said shoulder and the head of the rail; and, (g) mortise means in said one side edge of said head portion for connecting tenoned strip means to said body means to widen said head portion.

6. A railway level crossing structure comprising:

(a) elongated center plank means for insertion between the rail; and, (b) insert means, (c) said insert means including elongated body means for use between each plank and one side of a rail, (d) said body means including a head portion having one straight side edge for engaging one side of a plank or roadway;

(e) a shoulder extending outwardly from the other side edge of said head portion for insertion beneath the head of a rail;

(f) an inclined bottom portion extending downwardly from said head portion for resting against an inner top edge of a rail bottom;

(g) first sealing means for providing a seal between said one side edge of said head portion and an adjacent plank or roadway;

(h) second sealing means for providing a seal between said shoulder and the head of a rail, (i) longitudinally extending first groove means in one side edge of said head portion for receiving said first seal means; and, (j) second groove means in said shoulder for receiving said second seal means.

7. A structure according to claim 6, including outside plank means for use on the outer sides of the rails.

8. A structure according to claim 6, wherein said body means is formed of high molecular weight polyethylene.

9. A structure according to claim 7, wherein said body means is formed of high molecular weight polyethylene.

10. A structure according to claim 6, including a plurality of center planks; and flexible sealing strip means between said center planks.

11. A structure according to claim 7, including a plurality of center planks; and flexible sealing strip means between said center planks.

12. A railway crossing insert for use in a railway crossing structure of the type defined by center planks between the rails and, optionally outside planks on the outer sides of the rails, said insert comprising:

(a) elongated body means for use between each plank and one side of a rail, (b) said body means including a head portion having one straight side edge for engaging one side edge of a plank or roadway, (c) a shoulder extending outwardly from the other side edge of said head portion for insertion beneath the head of a rail;

(d) an inclined bottom portion extending downwardly from said head portion for resting against an inner top edge of a rail bottom;

(e) first sealing means for providing a seal between said one side edge of said head portion and an adjacent plank or roadway;

(f) second sealing means for providing a seal between said shoulder and the head of the rail;

(g) a longitudinally extending first groove means in said one side edge of said head portion for receiving said first seal means; and, (h) second groove means in said shoulder for receiving said second seal means.

13. A railway crossing insert according to claim 12, wherein said body means is formed of high molecular weight polyethylene.

14. A railway crossing insert according to claim 12, in combination with elongated center planks between a pair of rails, flexible sealing strip means between said center planks, and outside planks on each outer side of each rail for defining a level crossing.

15. A railway crossing structure comprising:

(a) a pair of parallel rails, each having a bottom flange and a rail head, (b) an elongated center plank means having first and second sides inserted between said pair of parallel rails, defining a horizontal plane therewith, (c) insert means for each of said rails including elongated body means inserted between said center plank means and one side of its respective rail, (d) track plate means extending horizontally beneath a bottom flange of each of rails and supporting its rail, (e) each of said track plate means extending outwardly in a horizontal plane from the bottom flange of its respective rail, (f) rail clips attached to each said track plate means and engaging its respective bottom flange, (g) one of said body means including a head portion having a side edge for engaging said first side edge of the plank means, (h) the other of said body means including a head portion having a side edge for engaging said second edge of said plank means, (i) each of said body means including a shoulder extending outwardly from the other side edge of said head portion and inserted beneath each of said rail heads, (j) said body means abutting said bottom flange and said center plank means; and, (k) said body means, said bottom flange, said center plank means and said track plate means forming a chamber around each of said rail clips.

16. The railway crossing structure of claim 15, further comprising:

(a) first and second roadway means located in the horizontal plane formed by said pair of parallel rails and said center plank means, (b) said pair of parallel rails extending between said first and second roadway means, (c) second insert means including elongated body means inserted between said first roadway means and one of said rails and elongated body means inserted between said second roadway means and the other of said rails, (d) each of said body means including a head portion having a side edge for engagement with its respective roadway, (e) each of said body means including a shoulder portion extending outwardly from the other side edge of said head portion and inserted beneath its respective rail head, (f) each of said body means abutting a bottom flange of its respective rail and abutting its respective roadway means, (g) track plate means extending horizontally beneath a bottom flange of each of said rails and outwardly between each rail and its respective roadway, (h) rail clips attached to each of said track plate means between each of said rails and its respective roadway, (i) said rail clips engaging its respective bottom flange, (j) said body means, said bottom flange, said roadway means and said track plate means forming a chamber around each of said rail clips.

17. The railway crossing structure of claim 15, wherein:

(a) said first and second sides of said center plank means include at least a portion of each first and second side being angled from a lower portion of said plank means outwardly to an upper portion of said plank means.

18. The railway crossing structure of claim 15, wherein:

each of said side edges includes a top and a bottom, (b) said elongated body has a sloped surface extending from said straight side edge bottom downwardly to said foot portion.

19. The railway crossing structure of claim 18, wherein:

(a) said shoulder portion protrudes outwardly from said body means and engages said rail directly beneath the rail head, (b) said foot portion has a convex surface and bears against the top of the rail bottom flange.

20. The railway crossing structure of claim 19, wherein:

(a) said downwardly extending sloped surface is spaced from the rail intermediate said shoulder portion and said foot portion.

* * * * *